United States Patent [19]

Klimaschka

[11] 3,937,406

[45] Feb. 10, 1976

[54] AGITATOR MILL

[75] Inventor: Norbert Klimaschka, Selb, Germany

[73] Assignee: Gebruder Netzsch Maschinenfabrik, Selb, Germany

[22] Filed: May 29, 1974

[21] Appl. No.: 474,183

[52] U.S. Cl. ..... 241/46.11; 241/30; 241/172

[51] Int. Cl.[2] ..... B02C 17/18

[58] Field of Search ..... 241/30, 37, 46.11, 46.15, 241/46.17, 170, 172, 173

[56] References Cited

UNITED STATES PATENTS 3,332,628 7/1967 Wadham ..... 241/30

FOREIGN PATENTS OR APPLICATIONS 4,642,825 1971 Japan ..... 241/30

*Primary Examiner*—Granville Y. Custer, Jr.

*Attorney, Agent, or Firm*—Karl W. Flocks

[57] ABSTRACT

An agitator mill with a grinding container, an agitator shaft rotatable therein, a cylinder mounted on the lower face of the grinding container, internally connected thereto, and containing at least a portion of a charge of grinding elements, and a piston movable in the cylinder so as to vary the packing in or the density of the grinding elements in the grinding container.

8 Claims, 3 Drawing Figures

AGITATOR MILL

BACKGROUND OF THE INVENTION

Material to be ground wet or to be dispersed in agitator mills is normally conveyed by a feed pump from below into a preferably cylindrical and very narrow grinding container and after it passes through the grinding zone it is removed at the upper end of the grinding container. A charge of grinding elements, which generally consists of approximately spherical grinding elements of steel, glass, ceramic or similar materials, is retained in the grinding container by means of a separation device; e.g., a screen or an annular slit. The material which is sufficiently ground or dispersed generally flows out through a lateral opening above the separation device.

The desired degree of fineness or dispersion of the material subjected to grinding is obtained on the one hand through a suitable arrangement or shape of the agitator mill and, on the other hand, through the selection of a certain charge of grinding elements, wherein the grinding is adjusted by the amount and size of the grinding elements, and through the regulation or control of the time-of-stay of the ground material in the grinding container, for which purpose the conveying power of the feed pump can be variable; e.g. by means of an infinitely variable gearing.

With the object of possibly varying the charge of grinding elements and also the density of packing of the grinding elements in the grinding container during the operation, there has been proposed in the prior art an agitator mill of the type described in British Pat. No. 1,314,789, whose piston, which can be displaced for the purpose of varying the density of packing of the grinding elements, has a piston rod or operation spindle which projects from the cylinder at the end extending away from the grinding container and is guided with possible axial displacement at such an end. In an embodiment of that agitator mill which comprises the cylinder mounted on the lower face of the grinding container, the inlet of the material to be ground is arranged approximately at the level of the lower end of the agitator shaft laterally on the grinding container. In another embodiment comprising the cylinder mounted on the side wall of the grinding container in the vicinity of its bottom, the inlet of the material to be ground is arranged in the botton of the grinding container coaxially with the agitator shaft. The axis of the cylinder extends in both cases at a right angle to the axis of the inlet for the material to be ground. Accordingly, there is the danger that the charge of the grinding elements may plug up the inlet for the material to be ground, if it is forced by the piston from the cylinder into the grinding container after the agitator shaft starts rotating. Indeed, in the case of the agitator mill of the prior art one could conceive the arrangement of the cylinder and the inlet for the material to be ground side by side on the bottom of the grinding container; however, this is possible only in the case where the cylinder possesses a considerably smaller diameter than the grinding container, which is again associated with the disadvantage that a considerable portion of the charge of the grinding elements may not be able to drop into the cylinder. The possibility of arranging both the cylinder and also the inlet for the material to be ground side by side on the side wall of the container is opposed by the fact that the flow of the material subjected to grinding passing through the inlet of the material to be ground into the grinding container would necessarily carry along a considerable portion of the grinding elements contained in the cylinder from the cylinder into the grinding container, even before the agitator shaft starts running, which is also the case where the axes of the cylinder and the inlet for the material to be ground extend at right angles to each other.

Meanwhile, the above discussed agitator mill possesses in relation to previously known mills the substantial advantage that at least a portion of the charge of the grinding elements passes into the cylinder when the piston is retracted. The said portion of the charge is thus removed from the grinding container so that even in the case where the grinding container is completely filled with the material to be ground the agitator shaft can be set in rotation with a driving power that is not substantially above the level of normal operating power since owing to the reduction in the charge of grinding elements in the grinding container the initial breakaway torque of the agitator shaft is low.

SUMMARY OF THE INVENTION

An object of the invention is to develop further an agitator mill of the type described above, in order to avoid with low structural expenditures the danger of plugging up the inlet for the material to be ground, while retaining and possibly intensifying the advantages found therein.

The present invention solves the problem of the prior art apparatus in that the piston is guided on a hollow guide rod that is attached in the cylinder and simultaneously forms the inlet for the material to be ground.

In the agitator mill of the present invention, the direction in which the grinding elements are forced by the piston, from the cylinder into the grinding container, corresponds to the direction of flow of the material to be ground in the inlet for such material. Therefore, the grinding elements displaced by the piston do not exhibit the tendency of plugging up the inlet for the material to be ground. On the other hand, the material to be ground which passes through the inlet for such material into the grinding container cannot flush out the grinding elements from the cylinder, as long as the piston is in its retracted position. Consequently, the filling of the cylinder with the grinding elements is guaranteed until the elements are displaced by the piston into the grinding container, after the agitator shaft starts running.

In a preferred embodiment of the invention, the end of the guide rod which faces the agitator shaft, or a sleeve bolted or screwed thereon, defines a narrow annular inlet gap together with the lower end of the agitator shaft, or a disk attached thereon, in an interchangeable manner. This arrangement is associated with the advantages, on the one hand, that the material to be ground flows in through the inlet for such material and is distributed uniformly through the inlet gap in every direction radial in regard to the cylinder. Accordingly, it cannot form a flow in the grinding container which could assume a direction in the grinding container leading toward the cylinder. On the other hand, the grinding elements cannot reach the inlet for the material to be ground when the inlet gap possesses suitable narrow dimensions.

A particular advantage may be obtained in this connection by providing the guide rod and/or the sleeve bolted thereto or screwed thereon with a possibility of axial displacement, so that the width of the annular gap can be varied.

Also, in the preferred embodiment of the invention, spokes may attach the end of said guide rod means which faces said agitator shaft to said grinding container.

The invention is preferably applied to an agitator mill of the type wherein the cylinder is arranged coaxially with the grinding container, since this arrangement possesses the advantage that in any case the grinding elements cannot be thrown by the agitator shaft directly against the wall of the cylinder. When a hollow guide rod for the piston is employed in accordance with the invention as inlet for the material to be ground, there is obtained the additional advantage that the grinding elements also cannot be thrown by the agitator shaft directly against the opening of the inlet for the material to be ground. In the case where the cylinder is arranged coaxially with the grinding container, a further development of the invention provides that the spokes be joined into a spoked-ring by means of an external ring, which is arranged between the lower face of the grinding container and the upper face of the cylinder, and an inner ring, which centers the guide rod. On the one hand, this greatly facilitates the mounting of a cylinder with the guide rod of the invention, on the grinding container, and even on grinding containers of existing older agitator mills. On the other hand, the spoked-ring separates the cylinder from the grinding container in such a manner that the movement of the ground material and of the charge of grinding elements produced by the agitator shaft in the grinding container is not transmitted to the grinding elements contained in the cylinder or is transmitted at most to a quite negligible extent, so that the wall of the cylinder is spared and sealed effectively in relation to the piston even after longer periods of operation.

Where there is provided a sleeve bolted to or screwed on the guide rod, it is attached to the inner ring of the spoked-ring, preferably in an interchangeable manner, and the guide rod is mounted on the end of the cylinder extending away from the agitator shaft, with the possibility of turning, and is provided with a head that is accessible for a wrench applied from the lower side of the cylinder. This arrangement of the invention provides the possibility of varying the inlet gap by turning the guide rod from the outside. If the head of the guide rod is mounted without a possibility of axial displacement on the end of the cylinder which is facing away from the agitator shaft, the axial position of the sleeve is changed in connection with elastic deformation of the spoked-ring, when the guide rod is turned, which changes the distance between the upper face of the sleeve and the lower face of the agitator shaft, or a disk attached thereto, thus changing the width of the inlet gap.

In addition, the head of the guide rod can be also guided, with the possibility of axial displacement, on the end of the cylinder which faces away from the agitator shaft and is fixed in axial direction only through its thread-connection to the sleeve. When the guide rod is turned in this case, its end facing the agitator shaft can be allowed to project from the sleeve to a smaller or greater extent, so as to vary also in this manner the inlet gap, which is limited in this case by the above-mentioned end of the guide rod itself.

As in an embodiment of the agitator mill of the prior art, the cylinder may be subjected to the action of a liquid under pressure on its side facing away from the grinding container, in accordance with a further development of the invention, it is advantageous in this case to store the liquid under pressure in a pressure container which is equipped with a compressed-gas cushion and a liquid-level indicator, the inner corss-section of the pressure container corresponding at least approximately to the inner cross-section of the cylinder reduced by the cross-section of the guide rod. On a liquid-level indicator on the pressure container there can be read the position of the piston in the cylinder and, therewith, also the degree to which the grinding container is filled with grinding elements.

Also in the present invention, in the preferred embodiment, the inner diameter of the cylinder is preferably at least approximately as large as the inner diameter of the grinding container.

BRIEF DESCRIPTION OF THE DRAWINGS

A complete understanding of the invention may be had from the following description of a particular embodiment of the invention, reference being made to the accompanying drawings in which.

DESCRIPTION OF THE PREFERRED EMBODIMENT

Figure 1:
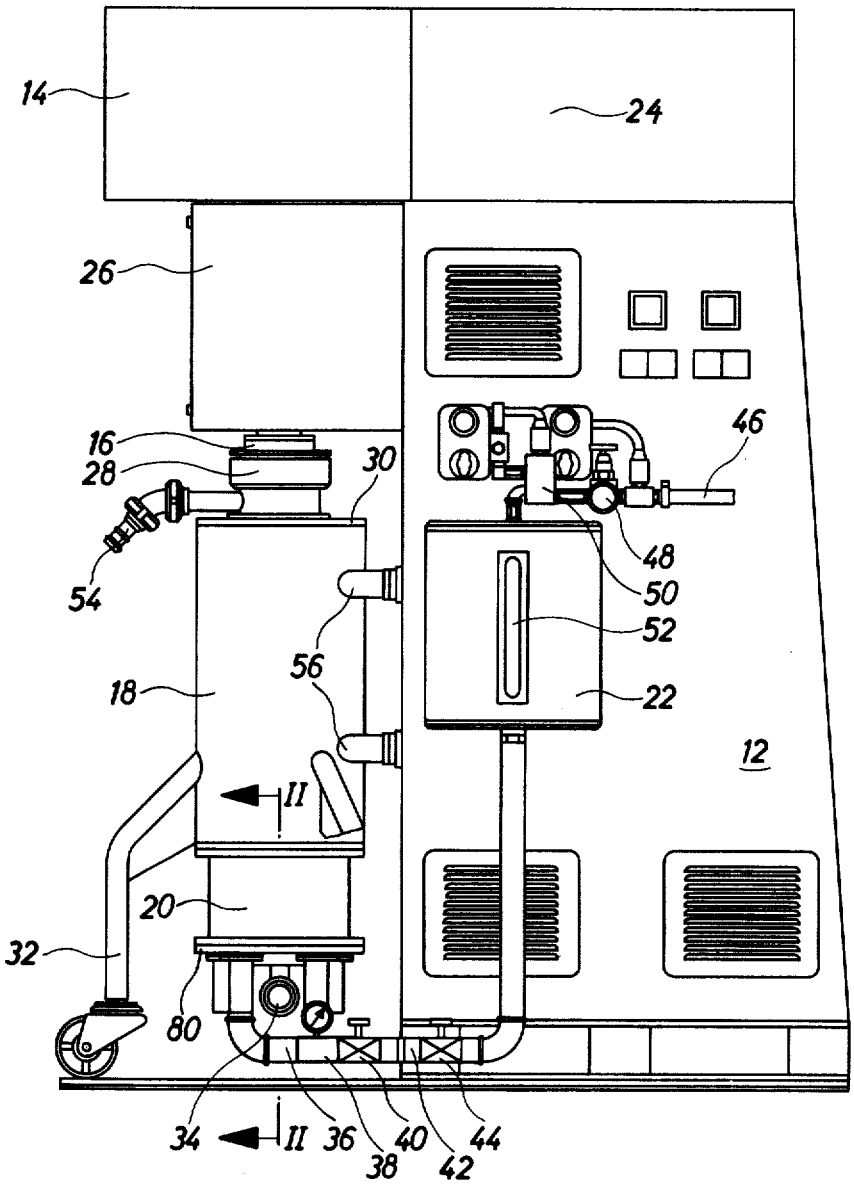
FIG. 1 is a side elevation of an embodiment of the along mill of the present invention.

Referring first to the over-all view shown as a side elevation of an agitator mill in FIG. 1, there are illustrated the main components comprising the said apparatus. A housing 12 comprises the framework for the over-all apparatus and includes a housing cap 14, an agitator shaft 16 journelled in housing cap 14, a grinding container 18 at the lower end of agitator shaft 16, a cylinder 20 attached to the lower face of grinding container 18, and a pressure container 22.

An electric driving motor (not shown) is located in the housing 12, probably most conveniently in section 24. The electric driving motor is connected through an infinitely variable gearing, located in housing cap 14, through a coupling, located in a hinged coupling housing 26 for easy accessibility thereto, in a detachable manner, to agitator shaft 16. From its coupling in housing 26 agitator shaft 16 extends through a packing box 28 that is attached to a cover 30 of grinding container 18. Grinding container 18 is supported on roller-legs 32 and may be detached and moved away from main housing 12 when agitator shaft 16 is uncoupled from its infinitely variable gearing and when the pipes connected to cylinder 20 are likewise uncoupled.

Figure 2:
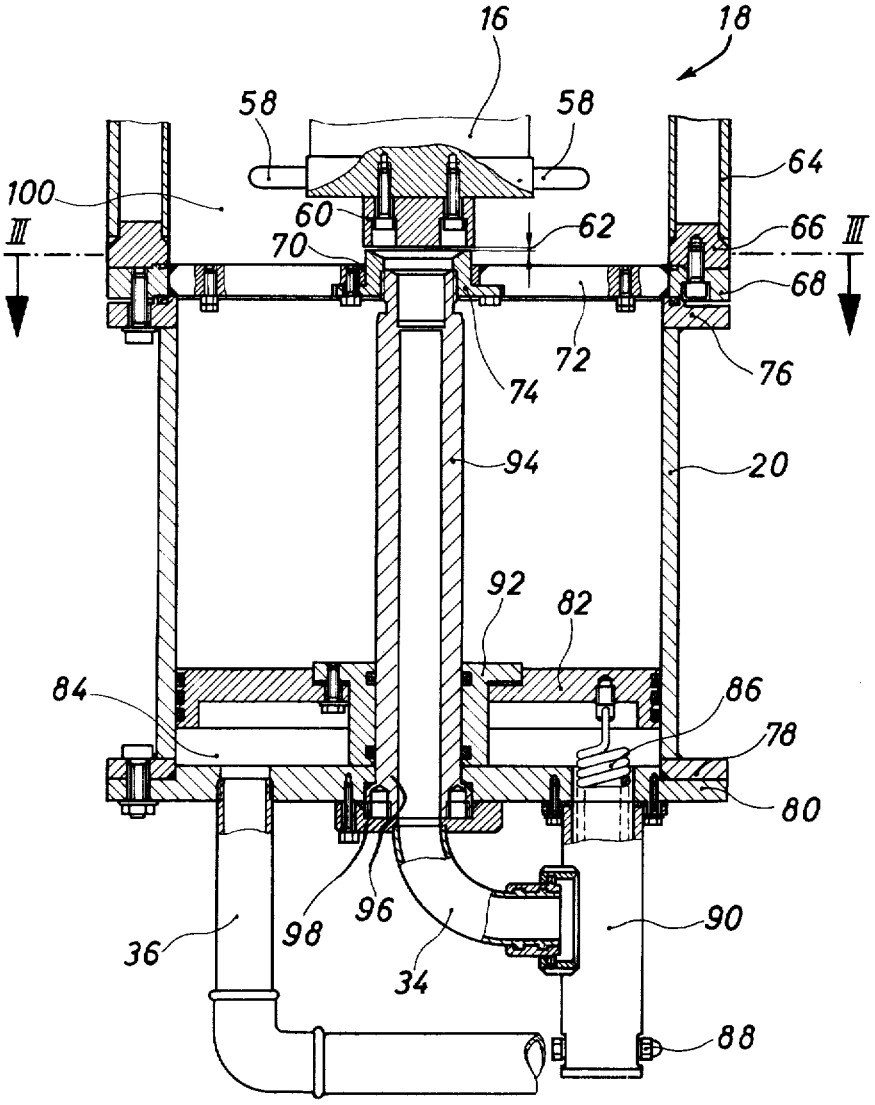
FIG. 2 is a vertical partial sectional view on an enlarged scale alone line II—II of FIG. 1.
Figure 3:
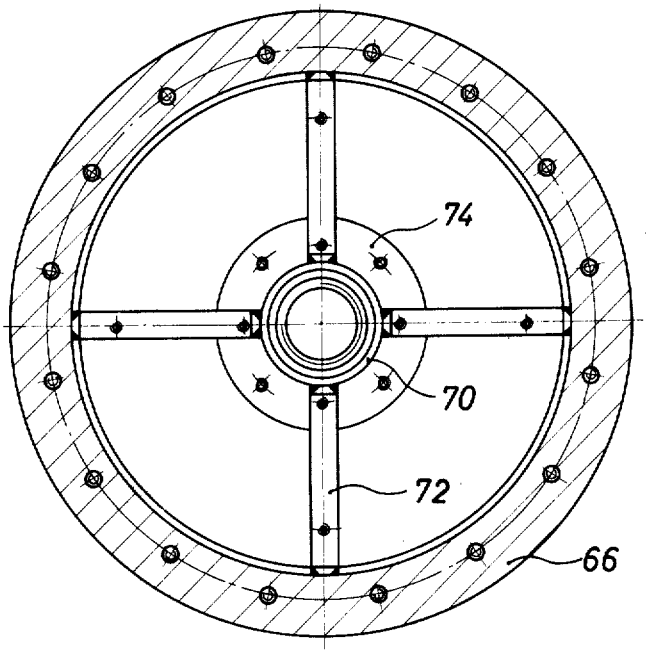
FIG. 3 is a horizontal sectional view along the line III—III of FIG. 2.

The pipes connected to cylinder 20 consist of a feed pipe to feed material to be ground into grinding container 18, which pipe is not illustrated but which is connected to a pipe elbow 34 on the lower side of cylinder 20 as illustrated in FIGS. 1 and 2. Also among such pipes is pressure pipe 36 which connects the interior of cylinder 20 to a pressure container 22 through a manometer 38, a first shutoff valve 40, a coupling 42, and a second shutoff valve 44. Pressure container 22 contains a hydraulic fluid that is subjected to the pressure of an air cushion. The air cushion is produced by a compressed air network 46, to which pressure container 22 is connected through a shutoff valve 48 and a pressure reducing valve 50. The level of hydraulic fluid in pressure container 22 is read in liquid level indicator 52.

Between packing box 28 and lid 30 of grinding container 18, an outlet 54 is located. The finely ground and/or dispersed ground material can flow through the outlet 54 into a collecting container or into a discharge pipe that can likewise be uncoupled if necessary for movement of container 18. Two arms 56 project from grinding container 18. These arms 56 are attached to housing 12 as long as grinding container 18 is situated in its operational position as illustrated in FIG. 1.

FIG. 2 is an axial section through cylinder 20 on an enlarged scale and shows only the lower end of agitator shaft 16 and grinding container 18.

Agitator shaft 16 is equipped with numerous agitator elements 58 of which only two are illustrated. An interchangeable disk 60 is attached at the lower end of agitator shaft 16. The disk 60 acts as a limit on an inlet gap 62 in the upper direction.

Grinding container 18 possesses a doubly cylindrical side wall 64 with the cavity between the double walls traversed by a flow of water. The cavity has a lower face wall 66.

An outer ring 68 of a spoked-ring is attached to lower face wall 66. The spoked-ring has at least three spokes 72 welded to outer ring 68 and to an inner ring 70. A sleeve 74 is inserted into inner ring 70 from below in an upward direction, its annular upper face defining the lower portion of inlet gap 62 in the downward direction. At its lower end, sleeve 74 is provided with a flange which is attached to inner ring 70 by means of bolts or screws. Sleeve 70 is thus held in an accurate manner coaxially in relation to grinding container 18.

An upper flange 76 of cylinder 20 is firmly attached by means of screws or bolts to outer ring 68. A bottom 80 of cylinder 20 is firmly attached also by screws or bolts to a lower flange 78 of cylinder 20. A pressure chamber 84 is provided between cylinder bottom 80 and a piston 82 guided in cylinder 20, with pipe 36 ending in chamber 84. A plurality of return springs 86 are attached to the lower face of piston 82, displaced at uniform angular intervals in relation to one another. Each of the springs 86 are attached at their lower end by a bolt 88, which bolt 88 extends transversely through the lower end of a tubular spring housing 90 attached by its flange from below to cylinder bottom 80.

A tubular guide rod 94 with a hollow center extends axially through cylinder bottom 80 and through a guide sleeve 92 arranged centrally in piston 82 and up through cylinder 20, the upper end of guide rod 94 being screwed into sleeve 74. At its lower end guide rod 94 is provided with an enlarged head 96 which is admitted from below partly into a countersunk position in cylinder bottom 80 and partly extending into a clamping ring 98 attached to cylinder bottom 80. Head 96 is firmly clamped between cylinder bottom 80 and clamping ring 98. Pipe elbow 34 is welded to clamping ring 98. Since, on the one hand, pipe elbow 34 is to be coupled to a feed pipe to feed in the material to be ground and, on the other hand, it is attached firmly to tubular guide rod 94 through clamping ring 98, guide rod 94 is employed not only for guiding piston 82 but also as an inlet for the material to be ground.

If clamping ring 98 is detached or unscrewed, from cylinder bottom 80, head 96 of guide rod 94 is free and can be engaged by a wrench. If guide rod 94 is rotated, it is screwed more or less into sleeve 74. However, since the guide rod 94 is fixed axially through cylinder bottom 80, on the one hand, and on the other hand, through clamping ring 98, after it is again screwed on or otherwise attached, any turning of guide rod 94 makes a vertical adjustment of sleeve 74 which is held against rotation. Within the narrow limits in which a change in the inlet gap 62 is of importance, such a vertical displacement is made possible either through elastic deformation of spokes 72 or by the sleeve 74 possessing a certain axial play with respect to inner ring 70. Accordingly, inlet gap 62 can be changed simply by detaching clamping ring 98 and turning guide rod 94.

The agitator mills of the type of the present invention generally use grinding elements with a diameter having a size of about 0.2 to 3 mm. In British Patent No. 1,314,789, previously mentioned, the size of 1.5 to 3 mm is indicated on page 1, line 70, however, from other previously published material it results, for instance, that such agitator mills can also operate with substantially smaller grinding elements. The size of annular gap 62 illustrated in the present invention in FIG. 2 is preferably adjusted such that the grinding elements are prevented from dropping into the hollow guide rod 94 when the supply of material to be ground is interrupted. Annular gap 62 is therefore adjustable preferably between a smallest height of about 0.1 mm and a largest height of about 2 mm. Hence it is useful to provide that the spokes are so elastic that their inner ends may be bent from a neutral position by about one millimeter each in a downward or upward direction. When the agitator mill of FIG. 2 has a normal size, a bending of spokes 72 by 1 mm in a downward direction or an upward direction does not create any difficulties when the spokes are, for instance, made of steel.

Within cylinder 20 the purpose of the space above piston 82 is to receive a certain portion of the charge of the grinding elements of the agitator mill, depending on the position of piston 82, and to remove in this manner such a portion of the charge of the grinding elements from grinding chamber 100, wherein agitator shaft 16 is operating, so as to facilitate in this manner the starting of agitator shaft 16 at the beginning of the operation.

The inner cross-section of cylinder 20, reduced by the cross-section of guide rod 94, correspond at least approximately to the inner cross-section of pressure container 22. The amount of fluid under pressure which is totally available in pressure container 22, pressure pipe 36, and chamber 84 of cylinder 20 remains constant during a displacement of piston 82 and is of such a magnitude that the level of liquid seen in liquid level indicator 52 corresponds to the distance between piston 82 and its upper end position.

In the standstill condition of the agitator mill, piston 82 preferably occupies its lower end position illustrated in FIG. 2, wherein at least part of the charge of grinding elements provided to operate in the grinding container 18 is contained in cylinder 20 so that the grinding container 18 itself contains only a remaining portion of the charge of grinding elements, or does not contain any grinding elements at all. Agitator shaft 16 is rotated by its drive motor, previously mentioned. As soon as the agitator shaft 16 has reached a specific speed valves 40 and 44 are opened allowing a fluid under pressure to flow from the container 22 through pressure pipe 36 into the pressure chamber 84 below piston 82. This grandually presses piston 82 upwardly so that it in turn gradually presses the grinding elements contained in cylinder 20 between the spokes 72 into the grinding space 100 of the grinding container 18. As soon as the grinding space 100 has received a sufficient amount of grinding elements, the material to be ground is pumped through pipe elbow 34, hollow guide rod 94 and annular gap 62 into the grinding space 100. The finished ground and possibly suspended ground material is discharged from the agitator mill continuously through outlet 54. During continuous operation piston 82 normally remains in its upper end position or at least in a position which is substantially above its lower end position.

If piston 82 is to be lowered again, for instance, to facilitate the processing of material to be ground having little viscosity, the pressure reducing valve 50 is adjusted such that the pressure in the container 22 is reduced. If necessary, shutoff valve 48 is closed completely and the pressure reducing valve 50 is adjusted to a pressure in the proximity of atmospheric pressure. Springs 68 are then in a position to draw piston 82 downwardly thus urging fluid from chamber 84 below piston 82 back into container 22.

It will be obvious to those skilled in the art that various changes may be made without departing from the scope of the invention and the invention is not to be considered limited to what is shown in the drawings and described in the specification.

What is claimed is:

1. An agitator mill comprising a grinding container, an agitator shaft rotatable therein, a charge of grinding elements contained in said grinding container, a cylinder mounted at the lower portion of said grinding container and opening into said grinding container, containing, piston means displaceable in said cylinder, and hollow guide rod means attached in said cylinder for guiding said piston means and simultaneously forming the inlet for material to be ground in the agitator mill, said cylinder receiving at least a portion of said charge of grinding elements, and thus reducing the packing density of said charge of grinding elements in said grinding container, when said piston means is in its lowermost position.

2. The agitator mill of claim 1, further characterized by the end of said hollow guide rod means facing said agitator shaft and the lower end of said agitator shaft defining a narrow annular inlet gap therebetween.

3. The agitator mill of claim 2, further characterized by a disk attached on said lower end of said agitator shaft defining the upper part of said narrow annular inlet gap.

4. The agitator mill of claim 2, further characterized by a sleeve screwed onto said end of said guide rod means facing said agitator shaft defining the lower part of said narrow annular inlet gap.

5. The agitator mill of claim 1, further characterized by spokes attaching the end of said guide rod means which faces said agitator shaft to said grinding container.

6. The agitator mill of claim 5, further characterized by said cylinder mounted coaxially with said grinding container, said spokes forming a spoked-ring having an outer ring and an inner ring connected by said spokes, said outer ring located between the lower face of said grinding container and the upper face of said cylinder, said inner ring connected on said guide rod means to center said guide rod means.

7. The agitator mill of claim 6, further characterized by a sleeve attached on said inner ring of said spoked-ring in an interchangeable manner and screwed onto the end of said guide rod means facing said agitator shaft, said guide rod means having a head on the end away from said agitator shaft protruding below the bottom of said cylinder, and mounted for turning on said cylinder bottom.

8. The agitator mill of claim 1, further characterized by means to subject said piston means to fluid pressure on its side facing away from said grinding container, said fluid pressure means including a pressure container for storing said fluid having a liquid level indicator and a compressed gas connection attached thereto, the inner cross-section of said pressure container corresponding substantially to the inner cross-section of said cylinder reduced by the cross-section of said guide rod means.

* * * * *